US008388459B2

(12) United States Patent
Chuck

(10) Patent No.: US 8,388,459 B2
(45) Date of Patent: Mar. 5, 2013

(54) GOLF SWING TRAINING DEVICE AND METHOD OF USE

(76) Inventor: Martin Chuck, Bend, OR (US)

( * ) Notice: Subject to any disclaimer, the term of this patent is extended or adjusted under 35 U.S.C. 154(b) by 472 days.

(21) Appl. No.: 12/560,247

(22) Filed: Sep. 15, 2009

(65) Prior Publication Data

US 2010/0069169 A1 Mar. 18, 2010

Related U.S. Application Data

(60) Provisional application No. 61/097,118, filed on Sep. 15, 2008.

(51) Int. Cl.
*A63B 53/04* (2006.01)
*A63B 57/00* (2006.01)

(52) U.S. Cl. ..... 473/219; 473/330

(58) Field of Classification Search ..... 473/324–350
See application file for complete search history.

(56) References Cited

U.S. PATENT DOCUMENTS

| | | | | | |
|---|---|---|---|---|---|
| 656,099 | A | * | 8/1900 | Dunn | 473/330 |
| 1,211,708 | A | * | 1/1917 | Hudson | 473/330 |
| 1,467,714 | A | * | 9/1923 | Doerr | 473/330 |
| 1,525,137 | A | * | 2/1925 | Lawton | 473/330 |
| 1,617,090 | A | * | 2/1927 | Worthington | 473/328 |
| 1,647,487 | A | * | 11/1927 | Vernon | 473/330 |
| 1,674,173 | A | * | 6/1928 | Haupt | 473/330 |
| 1,695,598 | A | * | 12/1928 | MacClain | 473/328 |
| D138,380 | S | * | 7/1944 | Myers | D21/743 |
| 2,472,978 | A | * | 6/1949 | Mahon | 473/325 |
| 2,665,909 | A | * | 1/1954 | Wilson | 473/330 |
| 2,826,417 | A | * | 3/1958 | Marcoccio | 273/129 R |
| 3,394,937 | A | * | 7/1968 | Allport | 473/293 |
| 3,759,527 | A | * | 9/1973 | Witherspoon | 473/306 |
| 3,830,503 | A | * | 8/1974 | Consoli | 473/328 |
| 3,908,996 | A | * | 9/1975 | Molinaro | 473/412 |
| 4,162,074 | A | * | 7/1979 | Thomson | 473/330 |
| 4,165,076 | A | * | 8/1979 | Cella | 473/325 |
| 4,508,342 | A | * | 4/1985 | Drake | 473/204 |
| 4,521,022 | A | * | 6/1985 | Schmidt | 473/330 |
| 4,671,513 | A | * | 6/1987 | Swanson | 473/328 |
| 4,725,062 | A | * | 2/1988 | Kinney, III | 473/330 |
| 4,881,739 | A | * | 11/1989 | Garcia | 473/313 |
| 4,902,015 | A | * | 2/1990 | Nebbia | 473/325 |
| 5,303,923 | A | * | 4/1994 | Garcia | 473/330 |
| 5,326,105 | A | * | 7/1994 | Fenton, Jr. | 473/328 |
| 5,354,060 | A | * | 10/1994 | Wooten | 473/313 |
| 5,382,019 | A | * | 1/1995 | Sneed | 473/304 |
| 5,447,310 | A | * | 9/1995 | Jernigan | 473/330 |
| 5,467,987 | A | * | 11/1995 | Perkins et al. | 473/340 |

(Continued)

FOREIGN PATENT DOCUMENTS

| | | | | |
|---|---|---|---|---|
| GB | 2240932 | A | * | 8/1991 |
| JP | 08117370 | A | * | 5/1996 |
| JP | 08238339 | A | * | 9/1996 |
| JP | 11309232 | A | * | 11/1999 |
| JP | 2000037483 | A | * | 2/2000 |
| JP | 2000061009 | A | * | 2/2000 |
| JP | 2002306648 | A | * | 10/2002 |
| JP | 2003220160 | A | * | 8/2003 |
| JP | 2010104741 | A | * | 5/2010 |
| WO | WO 9611727 | A1 | * | 4/1996 |
| WO | WO 2004035149 | A1 | * | 4/2004 |

*Primary Examiner* — Alvin Hunter
(74) *Attorney, Agent, or Firm* — Greenberg Trauric

(57) ABSTRACT

A training golf club includes a shaft having a gripping end and an opposite end coupled with a club head. A club head face includes a planar striking face that is spaced from a club head sole. A lower face of the club head extends between a lower edge of the striking face to the sole of the club head, downwardly and rearwardly from the plane of the striking face. Striking a ball below a mid-plane of the ball with the striking face produces a desirable shot, whereas striking the ball above the mid-plane produces an undesirable shot. Repeated use of the club teaches a user to consistently swing a club with a forward shaft lean for optimal impact with a ball.

13 Claims, 5 Drawing Sheets

U.S. PATENT DOCUMENTS

| | | | | | |
|---|---|---|---|---|---|
| 5,601,499 | A | * | 2/1997 | Segaline | 473/313 |
| 5,603,668 | A | | 2/1997 | Antonious | |
| 5,618,239 | A | * | 4/1997 | Rife | 473/330 |
| 5,643,106 | A | * | 7/1997 | Baird | 473/328 |
| 5,863,262 | A | * | 1/1999 | Donofrio | 473/330 |
| D412,729 | S | * | 8/1999 | Woodward | D21/743 |
| 5,971,866 | A | | 10/1999 | Adams et al. | |
| 6,162,131 | A | * | 12/2000 | Falzone | 473/330 |
| 6,267,690 | B1 | * | 7/2001 | Salmon | 473/325 |
| 6,471,601 | B1 | * | 10/2002 | McCabe et al. | 473/290 |
| 7,473,185 | B2 | * | 1/2009 | Anderson et al. | 473/325 |
| 7,648,424 | B2 | * | 1/2010 | Hinojosa | 473/236 |
| 8,062,148 | B1 | * | 11/2011 | Farkas | 473/313 |
| 2005/0014573 | A1 | | 1/2005 | Lee | |
| 2008/0058119 | A1 | | 3/2008 | Soracco et al. | |

* cited by examiner

GOLF SWING TRAINING DEVICE AND METHOD OF USE

BACKGROUND

The game of golf is hundreds of years old. For some, the game of golf is a passion; while for others, it is simply an enjoyable pastime. Regardless of a player's dedication to the game, it is far more enjoyable when the player can employ a proper golf swing consistently. Over the years, golfers have employed countless different swings. However, those swings that are "proper" are those that strike the golf ball with the "sweet spot" of the club face. By striking the ball with the sweet spot, a player allows the golf club to do a good majority of the work required in delivering the golf ball along an accurate and proper trajectory down the fairway or onto the green.

Unfortunately, many golfers are unable to swing their golf clubs in a manner that properly strikes the golf ball on a consistent basis. Often such players strike the golf ball with the face of the club just above a horizontal plane extending through the middle of the golf ball. This causes the leading edge of the club head, between the face of the club head and the sole, to engage the ball. In such instances, the ball typically skids across the ground in front of the player, falling far short of the intended trajectory or distance. This causes many golfers to rely on a false sense of security, provided through the use of a tee or tuffs of grass, which positions the golf ball in an elevated relationship to the ground surface. Using these supports, it is easier for many golfers to strike the golf ball with the sweet spot of the club head face, below the horizontal plane that extends through the middle of the ball. However, there are limited opportunities in a round of golf to use a tee or to position a ball "up" in the grass. Accordingly, most golfers are left frustrated with poorly struck shots throughout their round of golf. As such, most golfers do not enjoy the subtle nuances and strategy behind the game of golf, which are more commonly employed by professional golfers.

Various prior art teaching devices have been developed in an effort to train players to consistently strike the golf ball with the sweet spots of their clubs. For example, the practice golf club, taught by E. J. Hasten, Jr. et al. in U.S. Pat. No. 3,437,341, employs the use of a flat, generally circular disk that is secured to the sweet spot of a club head face using a screw or other fastener. The circular disk approximates the size of a golf ball and, presumably, when the golf ball is struck with the exposed face of the disk, the ball travels along a trajectory as though it has been struck by the sweet spot of the club face. However, the disk only covers the sweet spot portion of the club head face. Accordingly, a user of the practice club is able to maintain the player's previously undesirable swing in striking the golf ball with the toe or heel portions of the golf club, maintaining an improper impact with the ball and not teaching a consistent, proper swing. Moreover, the addition of a striking disk to an otherwise standard golf club could frequently change the characteristics of the club and its sweet spot. For example, the striking surface of the sweet spot in the disclosed practice golf club is positioned forwardly from the face of the club head. Accordingly, it is difficult for a user who becomes accustomed to using the practice golf club to translate the same, exact swing to standard clubs that do not use the raised disk. Additionally, club heads are provided to have a particular mass that assists in properly striking golf balls. The addition of a striking disk with a fastener poses the possibility of an inconsistent overall density within the club head, changing the characteristics of the impact of the club head with a golf ball. Moreover, there is no guarantee that the fastener and disk will not loosen over time, causing a loose connection with the face of the club and causing inconsistent impacts with golf balls as the impact disk shifts slightly from one position to another. Loose connections could also cause the disk to rattle as the club was swung and engaged with golf balls.

U.S. Patent Application Publication No. 2006/0160634 by Lee discloses a training golf club that employs a generally planar, round striking disk that is located at the sweet spot of the club head face. The Lee training club differs from the Hasten club in that the remaining portions of the club face are covered with a cushion having a thickness that approximates a thickness of the striking disk. Accordingly, when the Lee training club is used, proper ball trajectory could purportedly be attained by striking the golf ball with the striking disk on the club face. By striking the ball with the cushion, a significant portion of the impact force is absorbed and produces a shortened, less desirable golf shot. However, the design of this golf club trainer does not affect the trajectory of the golf ball when it is struck with the cushion, as opposed to the striking disk. The cushion is disposed along the same plane as the remainder of the club face. Accordingly, a user is not provided with a clear indication of an improperly struck ball as the ball can be frequently struck down the fairway with the same general trajectory but with a slightly reduced distance. Moreover, this training club design requires periodic replacement of the cushion as it is degraded by impacts with golf balls. Without replacement of the cushion, any affect on the distance that ball is struck is minimized by compression or degradation of the cushion.

Training golf clubs disclosed within U.S. Pat. Nos. 4,139,198 and 5,961,392 include projections that extended forwardly from the striking face of the golf clubs. Center portions of the projections, approximating the sweet spot of the club head face, are shaped to be planar and positioned parallel with the striking face of the club head. However, moving outwardly from the sweet spot, angular peaks are provided to extend further than the sweet spot portion of the projection. The angular peaks of the projection are provided to significantly change the path of the ball from its intended line as the golf ball strikes one of the angularly disposed faces of the peaks. However, as with other training devices, these designs do not use the actual striking face of the original club head. Rather, these designs forwardly position the sweet spot of the club face, using structural additions to the club head. Accordingly, problems with inconsistent density and location of the sweet spot plane can be frequently encountered. Moreover, such projections in training golf clubs do not provide the option of altering the entire club head face. Therefore, improper shots can still be maintained at the heel or toe of the club head.

Still other training golf clubs, such as those taught within U.S. Patent Application Publication No. 2002/0177486 and U.S. Pat. No. 7,104,897, use a hemispherical projection that extends outwardly from the approximated sweet spot of the club head face. In many instances, the hemispherical projection is shaped to approximate the shape of a golf ball. Such designs present potential shortcomings that include inconsistent club head densities and an artificially, forward-spaced striking face. Other undesirable results are potentially encountered. In particular, a spherical object would only be able to impact a spherical golf ball in a precise location in order to affect a straight and properly lofted ball trajectory. Using the old baseball principle that it is difficult to "hit a round ball with a round bat square," users of these types of training golf clubs may frequently find it difficult to hit the sweet spot on the projection in a consistent fashion. Such frustrating efforts can quickly diminish the user's desire to use such a training device and, therefore, limit its effectiveness.

SUMMARY

This Summary is provided to introduce a selection of concepts in a simplified form that are further described below in the Detailed Description. This Summary and the foregoing Background are not intended to identify key aspects or essential aspects of the claimed subject matter. Moreover, this Summary is not intended for use as an aid in determining the scope of the claimed subject matter.

A training golf club and various methods of use are provided that teach one or more types of golf swings to various users. In many embodiments, the training golf club and various methods of use seek to teach users to hit the "sweet spot" of most golf clubs on a consistent basis. The training golf club is provided with an elongated shaft with opposite end portions. A free end portion of the shaft is provided with a grip, such as those commonly used in the art of golf club fabrication. The opposite end of the shaft is coupled with a hosel portion of a club head. In some embodiments, the shaft may be secured with the hosel of the club head using various known methods and materials. In other embodiments, the shaft and the club head are integrally formed with one another. The club head is generally formed to have a toe-end portion positioned generally opposite a heel-end portion, adjacent the hosel. A sole defines a bottom portion of the club head and extends between the heel-end portion and the toe-end portion of the club head. A top-line portion defines an upper portion of the club head extending between the heel-end portion and toe-end portion of the club head.

In many embodiments, the club head is shaped to have a face having a peripheral edge portion defined by the heel-end portion, toe-end portion, sole and top-line portion of the club head. A rearward face may be provided opposite the face and in a wide range of shapes. Accordingly, the training golf club may be provided in the form of a golfing iron, a wood, putter, and any other derivation of such classes of golf clubs. The training golf club may also be fabricated from nearly any suitable material known in the art of golf club fabrication.

Several embodiments of the training golf club may provide the face of the golf club head with a planar striking face positioned at an angle with respect to the shaft and positioned so that a lower edge of the striking face is located in a spaced apart relationship with the sole of the club head. The angular relationship, or loft, can be provided according to the particular type of club being produced. In some embodiments, a lower face portion is provided to extend between the lower edge of the striking face to the sole of the club head. The lower face portion may be oriented to extend downwardly and rearwardly from the plane of the striking face. In various embodiments, the lower face portion of the club head, or a portion thereof, is curved. Some embodiments provide the lower face portion with a curved shape that approximates the radial shape of a golf ball. In some methods of use, such lower face portions can provide a generally downward striking force on the golf ball to produce an undesirable trajectory and distance through which the golf ball travels.

Other embodiments of the training golf club can be provided so that the club head face includes a toe-face portion that extends between the toe edge of the striking face to the toe-end portion of the club head. Various embodiments of the toe-face portion orient the toe-face portion to extend outwardly and rearwardly from the plane of the striking face. Still other embodiments of the training golf club can be provided with a heel-face portion that extends between a heel edge of the striking face to a heel-end portion of the club head adjacent the hosel. Such heel-face portions may be oriented to extend outwardly and rearwardly from the plane of the striking face. Various methods of using the training golf club that cause the ball to be struck with such toe-face or heel-face portions can, if desired, tend to cause the golf ball to travel along a trajectory that deviates to one side of the target, whether the target is the center of a fairway, green or the like. In various embodiments, the toe-face and heel-face portions may be curved, having single or multiple curves, compound curves, or one or more generally planar facets.

In various embodiments, the striking face may be formed to encompass the sweet spot of the club head. Alternate embodiments may cause the striking face to encompass more or less the full sweet spot of the face. In some embodiments, the lower edge of the striking face will be spaced from the sole of the club head by a distance of approximately 0.9 inches. In other embodiments, the lower edge of the striking face will be spaced from the sole of the club head by a distance of approximately 0.65 inches. Such positioning will generally locate the lower edge of the striking face just below a horizontal plane that extends through the middle of the golf ball when the training club is placed in a shaft-forward position as will be described below. This may also tend to position the lower edge of the striking face at or just above the horizontal plane extending through the middle of the golf ball, promoting optimal engagement between the striking face and the golf ball.

The training club may be formed as a new product, specifically for training purposes, using methods currently employed in the art of golf club fabrication. However, it is further contemplated that the training club can be formed by modifying or otherwise adapting an existing golf club, such as an iron, wood, or the like. In some embodiments, the shape of the striking face is determined by first approximating the sweet spot of the club head. With the desired shape of the striking face planed, one or more of the lower face portion, toe-face portion and heel-face portion may be formed into the club head. Where an existing club is modified, various known methods of removing portions of the original club head may be employed, including cutting, grinding, and the like.

In at least one method of use, a player may grasp the free end of the shaft and address the golf ball by positioning the club head between the golf ball and the player. The player may then move the shaft so that the lower edge portion of the striking face is positioned at least just below a horizontal plane extending through the middle of the golf ball. In doing so, various methods employed by the player will position the free end of the golf club forwardly of a vertical plane that extends through a midpoint of the golf ball and a player's body. Once the training golf club is set in its position with respect to the player and the golf ball, the player may assume a ready position that places the lower edge position of the striking face at least just below the horizontal plane passing through the middle of the golf ball.

With the position of the club head properly positioned with respect to the golf ball, the player may engage in the player's usual golf swing. In doing so, the player will draw the club head back from the golf ball in a backswing of any particular distance chosen by the player. The forward swing will commence as the player would do so in a normal golf swing impacting the ball with the striking face of the training golf club. By impacting the golf ball at or below the horizontal plane extending through the middle of the golf ball, it can be expected that the sweet spot of the golf club head will engage the golf ball, sending it along a desirable trajectory and distance toward a target area. Where impact is made with the golf ball at a location other than the striking face, such as the lower face portion of the club head, the golf ball will tend to follow a low trajectory and short distance of travel.

These and other aspects of the present system, methods of fabrication, and methods of use will be apparent after consideration of the Detailed Description and Figures herein. It is to be understood, however, that the scope of the invention shall be determined by the claims as issued and not by whether given subject matter addresses any or all issues noted in the Background or includes any features or aspects recited in this Summary.

DRAWINGS

Non-limiting and non-exhaustive embodiments of the present invention, including the preferred embodiment, are described with reference to the following figures, wherein like reference numerals refer to like parts throughout the various views unless otherwise specified.

DETAILED DESCRIPTION

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense.

Figure 1:
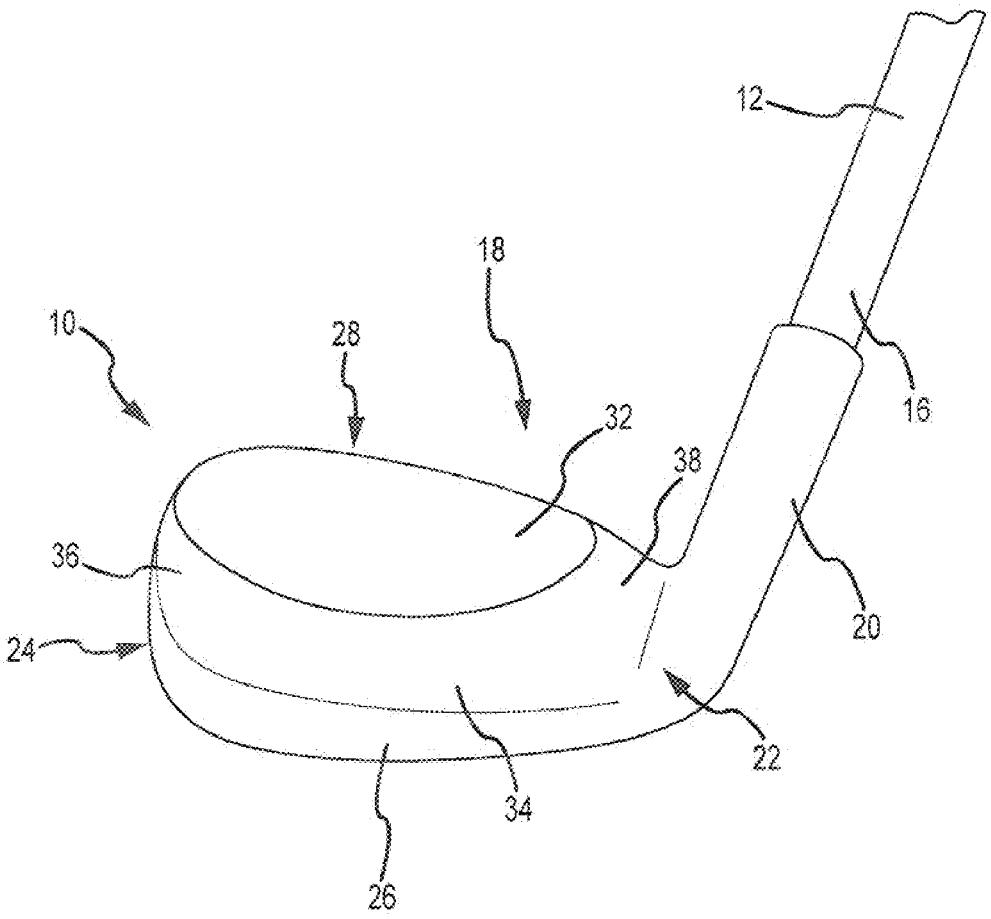
FIG. 1 depicts a front elevation view of one embodiment of the training golf club.
Figure 2:
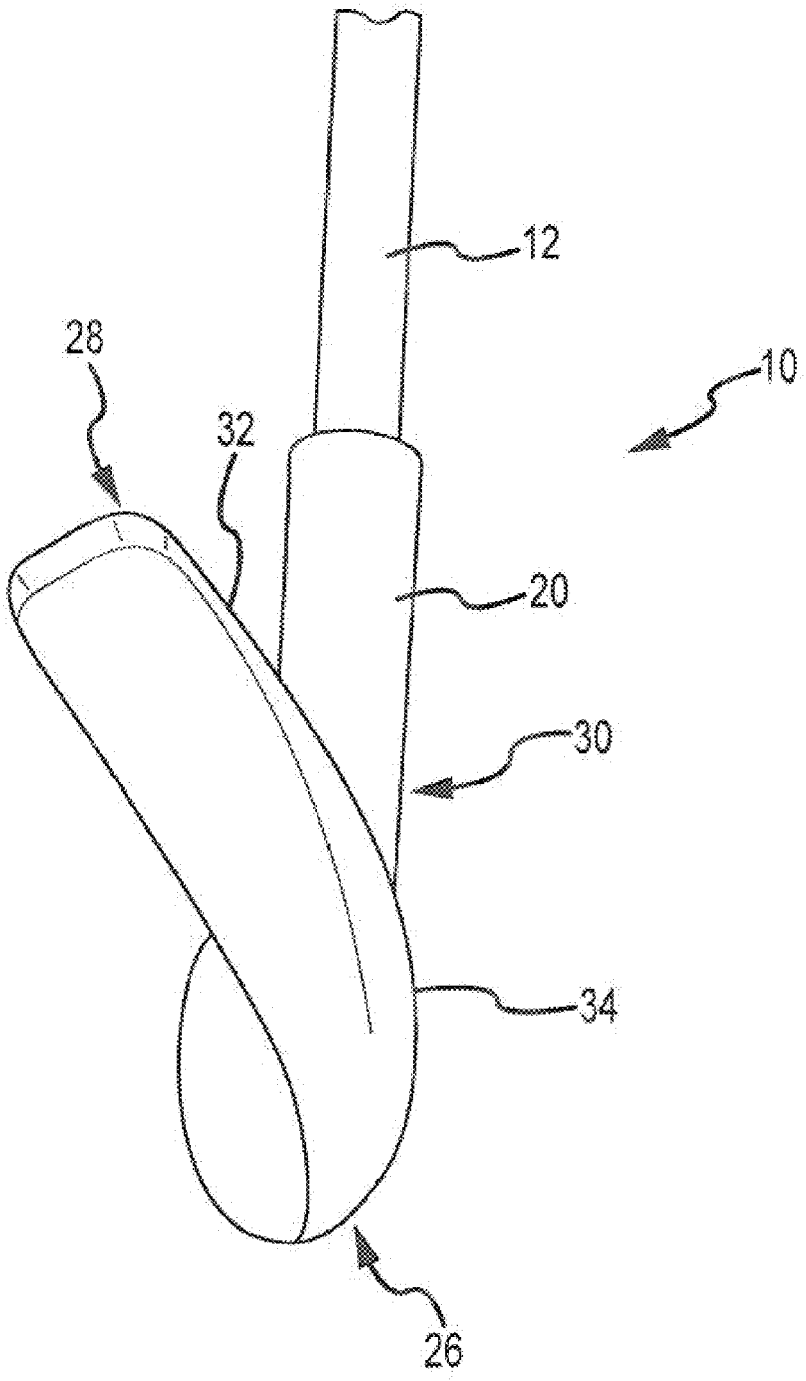
FIG. 2 depicts a toe-end elevation view of the training golf club depicted in FIG. 1.
Figure 3:
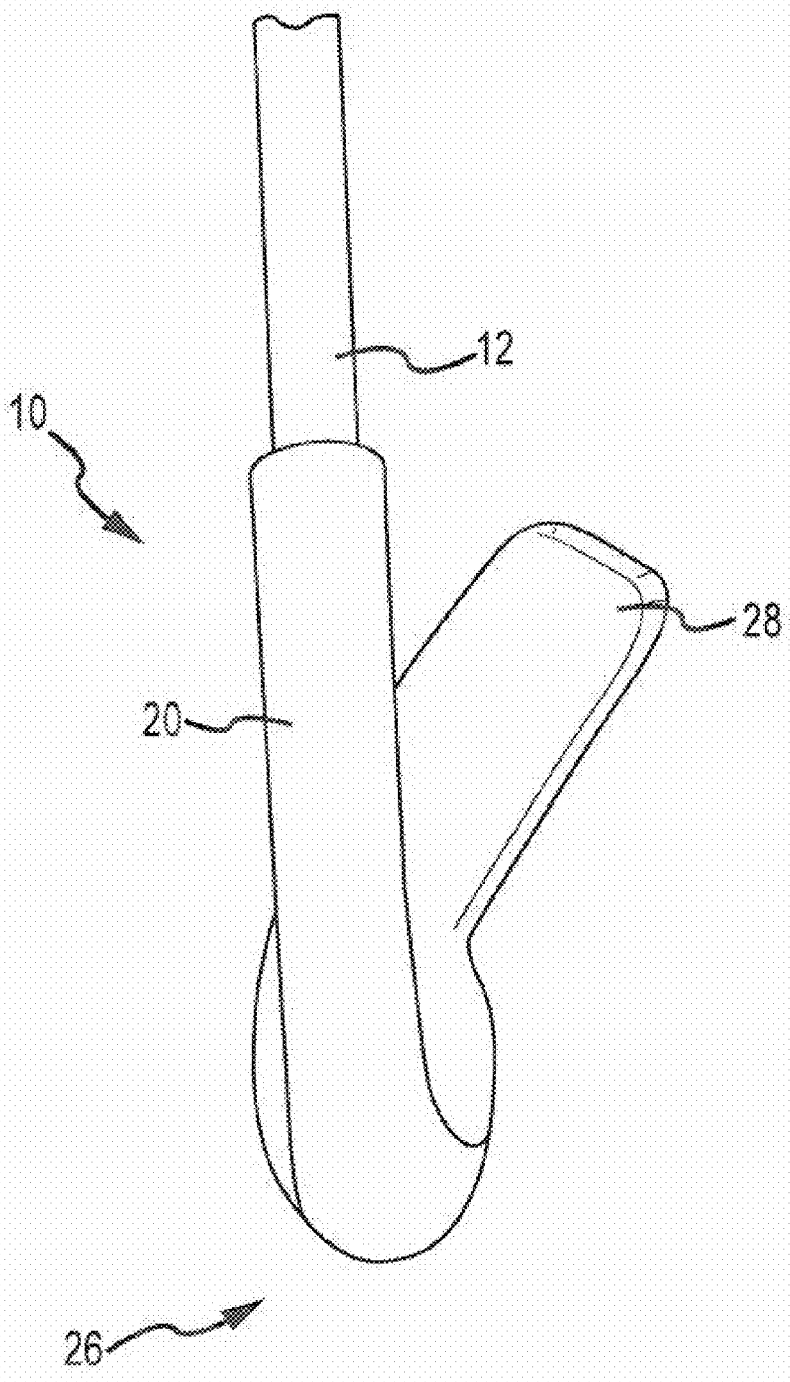
FIG. 3 depicts a heel-end elevation view of the training golf club depicted in FIG. 1.

With reference to FIGS. 1-3, a training golf club 10 may be provided for teaching one or more types of golf swings to various users. The training golf club 10 is provided with an elongated shaft 12, having a first end portion 14 and a second end portion 16. Commonly, the first end portion 14 of the shaft 12 will be provided with a grip, such as those commonly found on golf clubs. Such grips are well known in the art and may be provided in a nearly limitless number of designs and formed from any suitable materials known in the art of golf club fabrication. A golf club head is commonly provided with an elongated hosel 20 that is positioned at a heel-end portion of the golf club head 18. The hosel 20 is formed to have a free, distal end portion that is coupled with the second end portion 16 of the shaft 12. Methods and materials common to the art of golf club fabrication may be used in coupling the shaft 12 with the hosel 20. It is also contemplated that the shaft 12 and the club head 18 may be integrally formed with one another. A toe-end portion 24 is positioned generally opposite the heel-end portion 22. A sole 26 defines a bottom portion of the club head 18 that extends between the heel-end portion 22 and the toe-end portion 24 of the club head 18. Similarly, a top-line portion 28 defines an upper portion of the club head 18 that extends between the heel-end portion 22 and toe-end portion 24 of the club head 18. The club head 18 is further shaped to have a face 30 having a peripheral edge portion that is defined by the heel-end portion 22, toe-end portion 24, sole 26 and top-line portion 28 of the club head 18. A rearward face (not depicted) may be provided opposite the face 30 and provided in a nearly limitless variation of shapes, according to the particular style of golf club being fabricated and its intended use. To that end, it will be appreciated that the training golf club 10 may be provided in the form of a golfing iron, a wood, putter, and any other derivation of such classes of golf clubs. To that end, it is contemplated that the training golf club 10 may be fabricated from nearly any suitable material known in the art of golf club fabrication. In many embodiments, the training golf club 10 will be fabricated from materials that are similar to those used by common golf clubs, such as stainless steel, titanium, aluminum, and other metals, woods and composites. As such, several embodiments of the training golf club 10 will maintain a similar feel, density and weight as those experienced with ordinary golf clubs of the same type.

Several embodiments of the training golf club 10 will provide the face 30 of the golf club head 18 with a planar striking face that is positioned at an angle with respect to the shaft 12 and positioned so that a lower edge of the striking face 32 is located in a spaced apart relationship with the sole 26 of the club head 18. The angular relationship of the striking face 32 and the shaft 12 will be provided according to the particular type of club and desired loft. Accordingly, where the training golf club 10 is fabricated to serve as an iron, the striking face 32 can have a loft that varies from approximately twenty six degrees (from a vertically oriented shaft 12) to approximately forty degrees. A lower face portion 34 is provided to extend between the lower edge of the striking face 32 to the sole 26 of the club head 18. In many embodiments, the lower face portion 34 is oriented to extend downwardly and rearwardly from the plane of the striking face 32. In various embodiments, the lower face portion 34 of the club head 18 is curved from the lower edge portion of the striking face 32 to the sole 26 of the club head 18. Other embodiments may incorporate compound curves, one or more generally planar faces, and the like. However, in some embodiments, the lower face portion 34 is shaped to have a curve that approximates the radial shape of a golf ball. In such embodiments, a lower face portion 34 is shaped to provide a generally downward striking force on the golf ball, producing an undesirable trajectory and distance through which the golf ball will travel. Moreover, such shapes will generally enable the lower face portion 34 to consistently strike the golf ball above the horizontal plane that extends through the middle of the golf ball. As such, a consistent downward striking force or "muffed shot" is produced.

In some embodiments, the club head face 30 includes a toe-face portion 36 that extends between the toe edge of the striking face 32 to the toe-end portion 24 of the club head 18.

Various embodiments of the toe-face portion 36 will orient the toe-face portion 36 to extend outwardly and rearwardly from the plane of the striking face 32. Similarly, one or more embodiments of the training golf club 10 will be provided with a heel-face portion 38 that extends between a heel edge of the striking face 32 to a heel-end portion 22 of the club head 18 adjacent the hosel 20. Embodiments of the heel-face portion 38 will orient the heel-face portion 38 to extend outwardly and rearwardly from the plane of the striking face 32. The aforedescribed toe-face portion 36 and heel-face portion 38 will tend to strike the golf ball along a position that is laterally spaced from a vertical plane that extends through the middle of the golf ball. Accordingly, the orientations and shapes of the toe-face portion 36 and heel-face portion 38 will engage the curved side portions of the golf ball in a manner that will cause an impacted golf ball to travel along a trajectory that deviates to one side of the target, whether the target is the center of a fairway, green or the like. In such embodiments, it is contemplated that the toe-face portion 36 and the heel-face portion 38 may be shaped to be curved, have single or multiple curves, compound curves, or one or more generally planar facets. It is contemplated that the more severe the angular relationship that the toe-face portion 36 and heel-face portion 38 are provided with respect to the striking face 32 will produce greater deviations in intended ball trajectory.

It will be appreciated that many embodiments of the training golf club 10 will position the striking face 32 so that it encompasses the sweet spot of the club head 18. It is contemplated that the striking face 32 may be provided in various sizes to encompass more or less the sweet spot area of the face 30. Some embodiments of the golf club trainer 10 may be provided with a total head height that approximates prior art club heads of similar loft design, i.e. eight iron, wedge, etc. According to standard golf ball sizes used today, it is anticipated that the lower edge of the striking face 32, in some embodiments, may be spaced from the sole 26 of the club head 18 by a distance of approximately 0.9 inches. In other embodiments, the lower edge of the striking race 32 may be spaced from the sole of the club head 18 by a distance of approximately 0.65 inches. It is contemplated that the distance between the lower edge of the striking face 32 and the sole of the club head 18 in some embodiments may also vary between 0.65 inches and 0.9 inches. Some deviation from this range, higher or lower, may also produce acceptable results according to the present technology. Regardless, with reference to FIG. 4A, such positioning will generally locate the lower edge of the striking face 32 just below the horizontal plane "X" that extends through the middle of the golf ball when the training club 10 is placed in a proper, shaft-forward position as will be described below. This position of the lower edge portion of the striking face 32 will also tend to dispose the lower edge portion of the striking face 32 at or just above the horizontal plane extending through the middle of the golf ball when the shaft 12 is positioned in a generally planar relationship with the center line of the golf ball.

In at least one embodiment, the training golf club 10 may be provided with a club head 18 that is in the form of an iron with a loft of approximately thirty-six degrees and a lie (angle between a long axis of the hosel 20 and a horizontal plane that extends at least tangentially with the sole 26 of the club head 18) of approximately sixty-three degrees. These loft and lie angles may be considered to be commensurate with prior art golf club heads when providing an eight iron club head. However, these angles will vary according to the type of iron being constructed, such as a three iron, wedge, etc. In some such embodiments, the club head 18 may have a weight of approximately forty-three grams. Some prior art eight iron club heads are provided with a weight of approximately forty grams. Accordingly, club head dimensions and density can be maintained when comparing the training golf club 10 with prior art golf clubs.

In various embodiments, the training club 10 may be formed to have any combination of the aforedescribed features using methods currently employed in the art of golf club fabrication in forming a new training club 10. However, it is further contemplated that the training club 10 can be formed by modifying or otherwise adapting an existing golf club. This will be the case irrespective of the type of golf club, i.e. iron, wood, or the like. In such instances, the striking face 32 may be determined by first approximating the sweet spot of the club head 18 as it relates to the face 30. With the desired shape of the striking face 32 planed, one or more of the lower face portion 34, toe-face portion 36 and heel-face portion 38 may be formed into the club head 18. Various known methods of removing portions of the original club head 18 may be employed, including cutting, grinding, and the like.

Figure 4A:
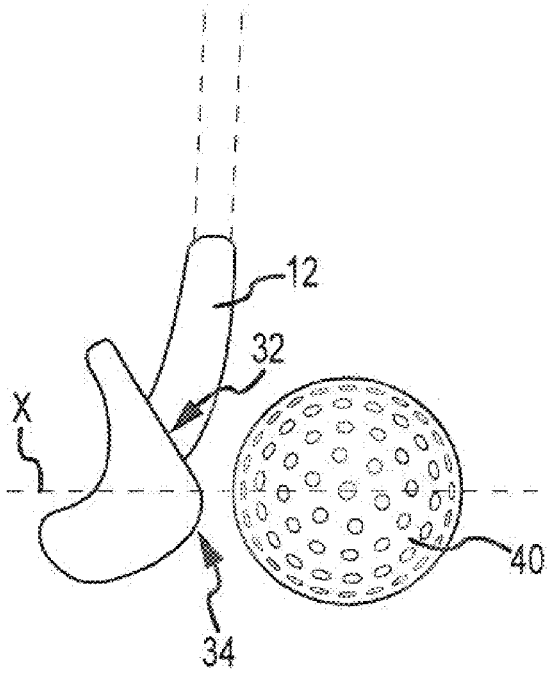
FIG. 4A depicts a toe-end elevation view of an embodiment of the training golf club as it could be aligned adjacent a golf ball with the shaft of the golf club in a vertical position, disposing the striking face of the golf club above a horizontal plane extending through the middle of the golf ball.
Figure 4B:
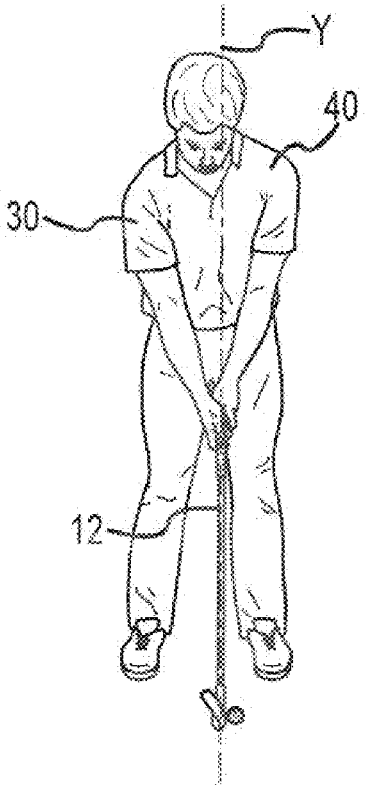
FIG. 4B depicts a top view of the training golf club and ball depicted in FIG. 4A in an address position but with the shaft and striking face of the golf club as otherwise positioned in FIG. 4A.
Figure 5A:
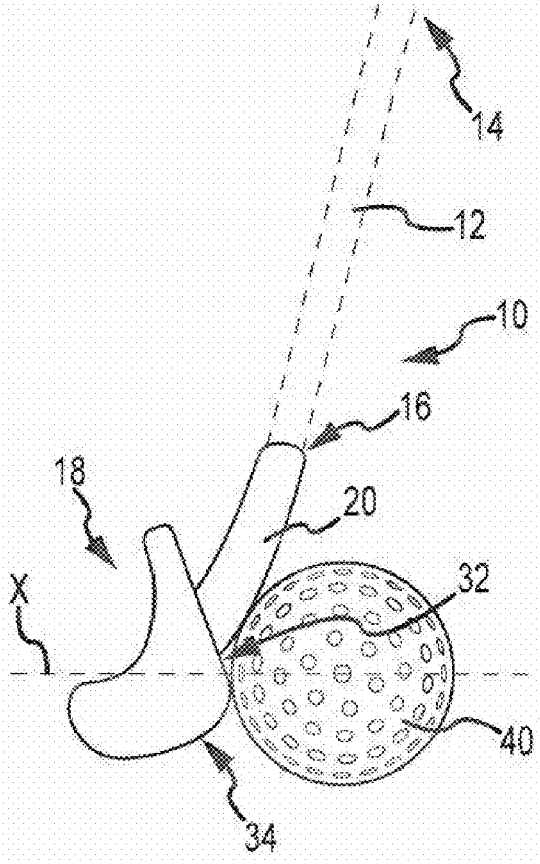
FIG. 5A depicts a toe-end elevation view of an embodiment of the training golf club positioned adjacent a golf ball with the shaft of the golf club in a forward angle position and at least a portion of the striking face extending below the horizontal plane that extends through the middle of the golf ball.
Figure 5B:
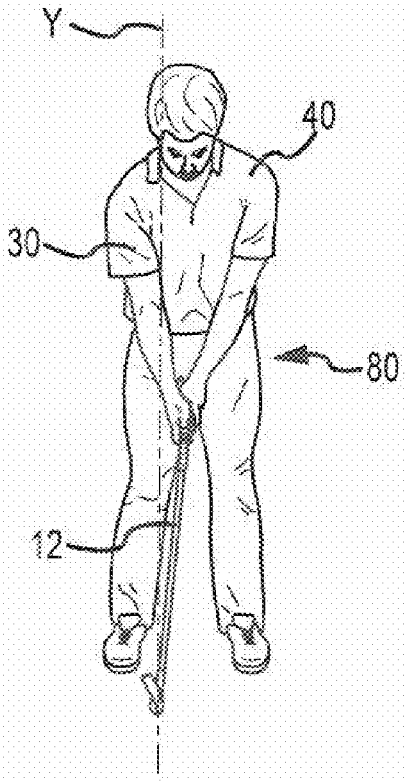
FIG. 5B depicts a top view of the training golf club and ball depicted in FIG. 5A in an address position but with the shaft and striking face of the golf club as otherwise positioned in FIG. 5A.

In use, a player will generally grasp the second end portion 16 of the shaft 12 in a manner comfortable for the player, which may include a nearly limitless number of golf club gripping styles. With reference to FIG. 4B, a common address position is depicted whereby the club head 18 is positioned between the golf ball 40 and the player but the shaft 12 is placed along a line that extends through the center of the golf ball 40 and through an approximate center of the player. With reference to FIG. 5B, the player may address the golf ball 40 by positioning the club head 18 between the golf ball 40 and the player. Accordingly, various methods of employing the training golf club 10 will have the player move the elongated shaft 12 so that the lower edge portion of the striking face 32 is positioned at least just below a horizontal plane "X" extending through the middle of the golf ball 40. In doing so, various methods employed by the player will position the first end portion 14 of the golf club forwardly of the vertical plane "Y" that extends through a midpoint of the golf ball and a player's body. Such alignment can be viewed in FIG. 5B. Once the training golf club is set in its position with respect to the player and the golf ball 40, the player may assume a ready position, such as that depicted in FIG. 5A. As depicted, the set position disposes the lower edge position of the striking face 32 at least just below the horizontal plane passing through the middle of the golf ball 40. With reference to FIG. 4A, an improper position may be viewed, where the lower edge portion of the striking face 32 is positioned just above the horizontal plane "X" extending through the middle of golf ball 40.

With the position of the club head 18 properly positioned with respect to the golf ball 40, the player may engage in the player's common or typical golf swing. As such, the player will draw the club head 18 back from the golf ball in a backswing of any particular distance chosen by the player. The forward swing will commence as the player would do so in a normal golf swing impacting the ball 40 with the striking face 32 of the training golf club 10. Where the striking face 32 impacts the ball 40 at or below the horizontal plane extending through the middle of the golf ball 40, it can be expected that the golf ball 40 will attain a desirable trajectory and distance toward a target area. However, where impact is made with the ball 40 in a position closer resembling that depicted in FIG. 4A, the lower face portion 34 will strike the golf ball 40, tending to cause a low trajectory and short distance of travel for the golf ball 40. Finally, where a toe-face portion 36 and/or heel-face portion 38 are provided, a swing that causes an impact between the golf ball 40 and either of the toe-face portion 36 or heel-face portion 38 will cause the golf ball 40 to travel through a path that lacks sufficient trajectory and deviates from the intended target to one side or the other. Accordingly, a desirable swing will strike the golf ball 40 with the striking face portion 38 whereby a vertical plane extending through the middle of the golf ball 40 engages the striking face 38. The degree to which the ball 40 deviates from its intended target may tend to depend on the shape and orientation of the lower face portion 34, a toe-face portion 36 or heel-face portion 38.

Accordingly, it will be appreciated that the training golf club and in its various embodiments and methods of use provide at least one or more of the following advantages:

- a training golf club that teaches players to consistently strike the ball with the sweet spot of the club head.
- a training golf club that indicates to the player that the club head struck the golf ball at an improper location by causing an errant trajectory and/or distance of the golf ball.
- a training golf club that may be constructed as any type of iron, wood, or other specialty club, of any desired loft.
- a training golf club that may be fabricated as a new training club or may be formed by modifying an existing golf club.
- a training golf club that trains players to consistently use a "hands forward" position throughout a golf swing to more consistently engage the sweet spot of any golf club.
- a training golf club that is relatively simple and inexpensive to fabricate.
- a training golf club that is relatively simple to use by players of a wide range of abilities.
- a training golf club that closely emulates many of the same characteristics exhibited by standard golf clubs when a golf ball is struck at the sweet spot.

Although the training device 10 has been described in language that is specific to certain structures, materials, and methodological steps, it is to be understood that the invention defined in the appended claims is not necessarily limited to the specific structures, materials, and/or steps described. Rather, the specific aspects and steps are described as forms of implementing the claimed invention. Since many embodiments of the invention can be practiced without departing from the spirit and scope of the invention, the invention resides in the claims hereinafter appended. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. A training golf club for teaching a manner of swinging golf clubs to a user, the golf club comprising:

an elongated shaft having a first end portion and a second end portion;

the first end portion having a grip;

a club head having:

(i) an elongated hosel positioned at one end portion of the club head and having a distal end portion that is coupled with the second end portion of the shaft;

(ii) a toe that defines an opposite end portion of the club head;

(iii) a sole that defines a bottom portion of the club head that extends between the opposite ends of the club head;

(iv) a top line portion that defines an upper portion of the club head and extends between the opposite ends of the club head; and (v) a face having a peripheral edge defined by the opposite end portions, sole and top line of the club head; and the face of the club head having:

(i) a planar striking face that is positioned at an angle with respect to the shaft and positioned so that a lower edge of the striking face is located in a spaced-apart relationship with the sole of the club head such that a lower edge of the striking face is at least 0.65 inches above said sole of the club head, said planar striking face angled rearwardly and upwardly from a bottom to a top thereof; and (ii) a lower face portion that extends between the lower edge of the planar striking face to the sole of the club head, whereby the lower face portion is oriented to extend downwardly and rearwardly from the plane of the striking face.

2. The training golf club of claim 1 wherein:

the lower face portion of the club head face is curved from the lower edge of the striking face to the sole of the club head.

3. The training golf club of claim 2 wherein:

the curve of the lower face portion of the club head is shaped to approximate the radial shape of a golf ball.

4. The training golf club of claim 1 wherein:

the club head face further includes a toe face portion that extends between a toe edge of the striking face to the toe of the club head, whereby the toe face portion is oriented to extend outwardly and rearwardly from the plane of the striking face.

5. The training golf club of claim 4 wherein:

the toe face portion of the club head face is curved from the toe edge of the striking face to the toe of the club head.

6. The training golf club of claim 1 wherein:

the club head face further includes a heel face portion that extends between a heel edge of the striking face to a heel of the club head, adjacent the hosel, whereby the heel face portion is oriented to extend outwardly and rearwardly from the plane of the striking face.

7. The training golf club of claim 6 wherein:

the heel face portion of the club head face is curved from the heel edge of the striking face to the heel of the club head.

8. The training golf club of claim 1 wherein:

the club head face further includes:

(i) a toe face portion that extends between a toe edge of the striking face to the toe of the club head, whereby the toe face portion is oriented to extend outwardly and rearwardly from the plane of the striking face; and (ii) a heel face portion that extends between a heel edge of the striking face to a heel of the club head, adjacent the hosel, whereby the heel face portion is oriented to extend outwardly and rearwardly from the plane of the striking face.

9. A method of forming a training golf club, the method comprising:

configuring a golf club, with a first end portion and a second end portion and a club head coupled with the second end portion of the golf club;

forming the club head to have:

(i) an elongated hosel positioned at one end portion of the club head and having a distal end portion that is coupled with the second end portion of the shaft;

(ii) a toe that defines an opposite end portion of the club head;

(iii) a sole that defines a bottom portion of the club head that extends between the opposite ends of the club head;

(iv) a top line portion that defines an upper portion of the club head and extends between the opposite ends of the club head; and (v) a face having a peripheral edge defined by the opposite end portions, sole and top line of the club head; and shaping the face of the club head to have:

(i) a planar striking face that is positioned at an angle with respect to the shaft and positioned so that a lower edge of the striking face is located in a spaced-apart relationship with the sole of the club head such that a lower edge of the striking face is at least 0.65 inches above said sole of the club head, said planar striking face angled rearwardly and upwardly from a bottom to a top thereof; and (ii) a lower face portion that extends between the lower edge of the planar striking face to the sole of the club head, whereby the lower face portion is oriented to extend downwardly and rearwardly from the plane of the striking face.

10. The method of claim 9 further comprising:

shaping the lower face portion of the club head face to be curved from the lower edge of the striking face to the sole of the club head.

11. The method of claim 9 further comprising:

shaping the club head face to include a toe face portion that extends between a toe edge of the striking face to the toe of the club head, whereby the toe face portion is oriented to extend outwardly and rearwardly from the plane of the striking face.

12. The method of claim 9 further comprising:

shaping the club head face to include a heel face portion that extends between a heel edge of the striking face to a heel of the club head, adjacent the hosel, whereby the heel face portion is oriented to extend outwardly and rearwardly from the plane of the striking face.

13. The method of claim 9 wherein:

shaping the face of the club head to have a lower face portion that is oriented to extend downwardly and rearwardly from the plane of the striking face includes the removal of material from the golf head between the lower edge of the striking face to the sole of the club head.

* * * * *